US007108212B2

(12) United States Patent
Latham

(10) Patent No.: US 7,108,212 B2
(45) Date of Patent: Sep. 19, 2006

(54) ANGULAR TOOL AND HOLDING BLOCK

(75) Inventor: Winchester E. Latham, Avon, IN (US)

(73) Assignee: Keystone Engineering & Manufacturing Corporation, Avon, IN (US)

( * ) Notice: Subject to any disclaimer, the term of this patent is extended or adjusted under 35 U.S.C. 154(b) by 216 days.

(21) Appl. No.: 10/705,709

(22) Filed: Nov. 11, 2003

(65) Prior Publication Data

US 2005/0098015 A1 May 12, 2005

(51) Int. Cl.
*B02C 18/18* (2006.01)

(52) U.S. Cl. ..... 241/294; 299/39.8; 407/101; 144/218

(58) Field of Classification Search ..... 241/294; 299/39.8; 82/158, 160; 407/46, 47, 101, 407/108; 144/218, 241
See application file for complete search history.

(56) References Cited

U.S. PATENT DOCUMENTS 2,949,946 A * 8/1960 Johnson ..... 144/162.1
3,146,961 A * 9/1964 Putnam, Jr. ..... 241/191
3,321,145 A * 5/1967 Gorman ..... 241/189.1
3,489,042 A 1/1970 Papp
4,057,294 A 11/1977 Krekeler
4,480,873 A 11/1984 Latham
4,609,227 A 9/1986 Wild et al.
4,621,870 A 11/1986 Levefelt
4,693,518 A 9/1987 Sulosky et al.
4,936,516 A * 6/1990 Hench ..... 241/294
5,052,757 A 10/1991 Latham
5,056,243 A 10/1991 Sprunger et al.
5,186,575 A 2/1993 Wirtgen
5,322,351 A 6/1994 Lent
5,370,448 A 12/1994 Sterwerf, Jr.
5,417,131 A 5/1995 Robertson
5,904,408 A 5/1999 Olson et al.
6,183,170 B1 2/2001 Wald et al.
6,523,768 B1 2/2003 Recker et al.

FOREIGN PATENT DOCUMENTS

GB 1066251 4/1967

* cited by examiner

*Primary Examiner*—Mark Rosenbaum
(74) *Attorney, Agent, or Firm*—Brinks Hofer Gilson & Lione

(57) ABSTRACT

A cutting tool holder, a cutting bit, and a retainer maintaining the cutting bit at a prescribed position relative to the tool holder. The cutting bit is received in a slot located in a first lateral surface that extends through the top surface. The retainer is received in an opening included in the first lateral surface that intercepts the slot. The retainer includes a planar tapered surface that contacts an upwardly and laterally facing oblique surface on a lower end of the cutting bit to hold the lower end of the cutting tool in contact with a lower surface of the slot.

17 Claims, 7 Drawing Sheets

Fig. 9
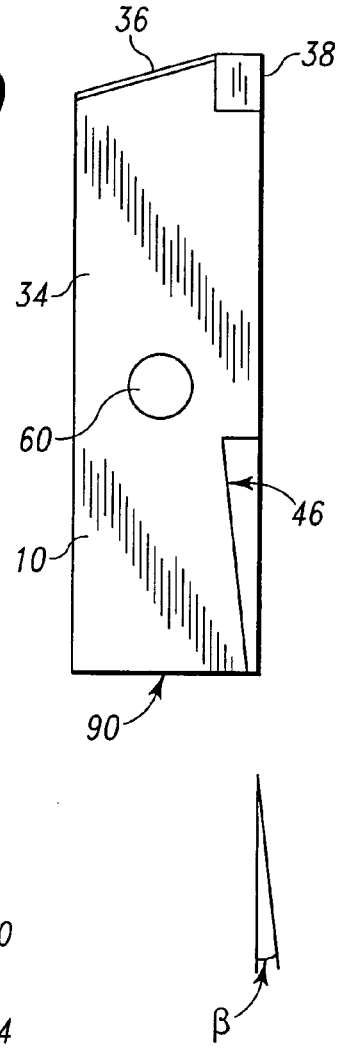
Fig. 8
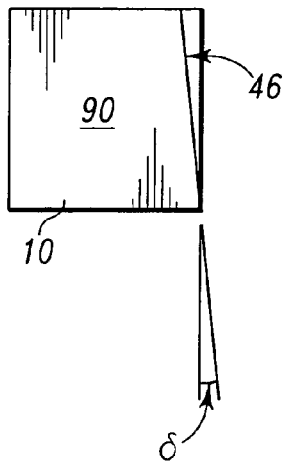
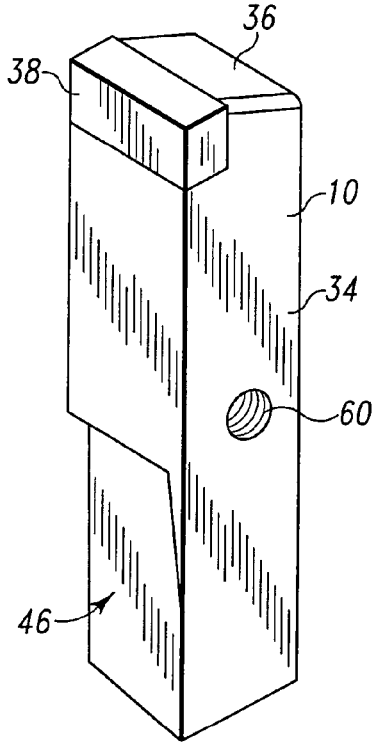
Fig. 7

ANGULAR TOOL AND HOLDING BLOCK

BACKGROUND

1. Technical Field

The present invention relates generally to a cutting tool used with a holder having a seat to receive the cutting tool including a separate fastener to clamp the tool in the seat. The invention particularly relates to cutter tools and holding blocks for such tools that can be employed in coal mining, road cutting, trenching, trash-shredding and tree stump removing apparatus.

2. General Background

In general, roadway cutting, coal mining, tree stump removing, and similar equipment known in the prior art includes a rotary driven cylindrical comminuting drum which acts to scarify and to mine the target area such as the top portion of an asphaltic road surface in situ. The rotary driven drum can include flighting on the drum which acts to collect the mined material toward the center of the drum where it can be removed. Often the mined material is remixed with additional bituminous material and thereafter re-deposited as a newly formed smooth asphaltic surface.

In some prior art devices of this type, the flighting is itself formed from a plurality of cutting tool holders which are connected to the curved surface of the cutting drum. Additionally or alternatively, cutting tool holders can be selectively fixed to the cutting drum in any desired pattern with or without flighting to achieve a particular desired cutting or mining surface effect. A plurality of the cutting tool holders can be arranged end-to-end so as to form cutting groups or even a continuous helical flighting, the top surface of the cutting tool holder being spaced outwardly from the curved surface of the drum.

The top surface of the cutting tool holder includes openings into which conventional cutting bits are received. The cutting bits typically include an outer end having a recess receiving a fixed tip of tungsten carbide or similar material. The cutting bits can be picks adapted to rotate in the cutting bit supporting members. Particularly in the presence of abrasive dust from the roadway mining other similar operation, the rotational movement of such cutting bits acts to wear and enlarge the recesses in which the cutting bit is received. If the wear becomes sufficient, the cutting bit may no longer be satisfactorily retained in the cutting bit supporting member.

As an alternative, the cutting bits can have generally angular body portions adapted to be held at a fixed position in the cutting tool holder. Such fixed position support aids in reducing the movement induced abrasive wear, but can make replacement of the cutting bits difficult unless the configuration of the cutting tool holder and any associated retaining means are properly configured along with a suitable cooperating base configuration for the cutting bit itself.

Thus, there remains a need for a cutting bit and a holder that retains the cutting bit at a prescribed position during any mining, cutting or other similar operation, which also enables quick replacement of the cutting bit at the same location with a minimum of effort and time. Such a cutting tool should be capable of being advantageously employed in a variety of cutting and mining operations under severe conditions.

BRIEF SUMMARY

A cutting tool of the present invention includes a tool holder, a cutting bit, and a retainer or maintaining the cutting bit at a prescribed position relative to the tool holder. The tool holder includes a base, lateral surfaces extending upward from the base to an uppermost edge of each lateral surface, and a top or crown surface connecting uppermost edges of the lateral surfaces. The tool holder base can be arcuately concave to facilitate fixation of the tool holder to a cylindrical drum or other surface. The tool holder base can also include a flat portion set at a desired rake angle. A slot can be located in a first of the lateral surfaces and can extend through the top surface of the tool holder. An opening can be included on the first lateral surface that intercepts the slot.

The cutting bit can include a generally rectangular body portion, which can be square, dimensioned so that the cutting bit body can be at least partially received in the tool holder slot at a fixed orientation. When so received, an upper end of the cutting bit, which includes a cutting surface, desirably projects above the tool holder top surface. The cutting bit also has a lower planar tapered portion-that is obliquely inclined to face laterally and upwardly. The lower planar tapered portion of the cutting bit can upwardly inclined at an angle of between about 1° and 5° and laterally inclined at an angle of between about 5° and 15°. The cutting bit body portion can have a lateral dimension exceeding the lateral dimension of the tool holder rectangular slot so that an edge of the cutting bit body portion projects from the tool holder first lateral surface.

The retainer has a perimeter surface dimensioned to be received in the opening in the tool holder first lateral surface. The retainer is received in the opening by movement of the retainer relative to the tool holder along a line of action. The line of action can be perpendicular to the first lateral surface. The retainer includes a planar tapered surface inclined with respect to the line of action that intersects the perimeter surface. The planar tapered surface can be inclined at an angle about equal to the lateral angle of inclination of the lower planar tapered portion of the cutting bit. As the retainer is inserted into the opening, the planar tapered surface of the retainer can contact the lower planar tapered portion of the cutting bit so that a downward and laterally inward force can be applied to the cutting bit by the retainer to maintain the cutting bit in the tool holder slot.

The movement of the retainer within the opening and the amount of force applied to the cutting bit by the retainer can be controlled by a tension element that can extend through an opening in a second of the lateral surfaces aligned with the line of action. The tension element can extend between the retainer and the second lateral surface to apply a force drawing the retainer into the tool holder opening. The tension element can be a screw threaded fastener having a head that can be positioned outside the second lateral surface of the tool holder. The tension element can also have a threaded portion engaged in a threaded opening in the retainer. Surface to surface contact between the retainer and the cutting bit can be facilitated by making the opening in the tool holder first lateral surface circular and the retainer perimeter surface cylindrical so that the retainer can, if necessary, rotate within the opening to achieve a desired alignment.

Additional retention elements can help secure the cutting bit to the tool holder. For example, the tool holder can include an opening in the second of the lateral surfaces aligned with the slot in the first lateral surface. The rectangular body portion of the cutting bit can also include an opening positioned to be aligned with the opening in the second lateral surface. A fastener can be inserted into the aligned openings to help secure the cutting bit to the tool holder. The fastener can include a head that can be positioned outside the second lateral surface of the tool holder. Both the head of the fastener and the head of the tension element can be at least partially surrounded by a wear protector.

Additional features of the present invention can be appreciated by those skilled in the art from the following description of a preferred embodiment illustrated in the accompanying drawings.

BRIEF DESCRIPTION OF THE DRAWINGS

FIG. 7 is a perspective view of a tool of the present invention.

FIG. 8 is a bottom plan view of the tool shown in FIG. 7.

FIG. 9 is an elevation view of the tool shown in FIGS. 7 and 8.

DESCRIPTION OF THE PREFERRED EMBODIMENTS

Figure 1:
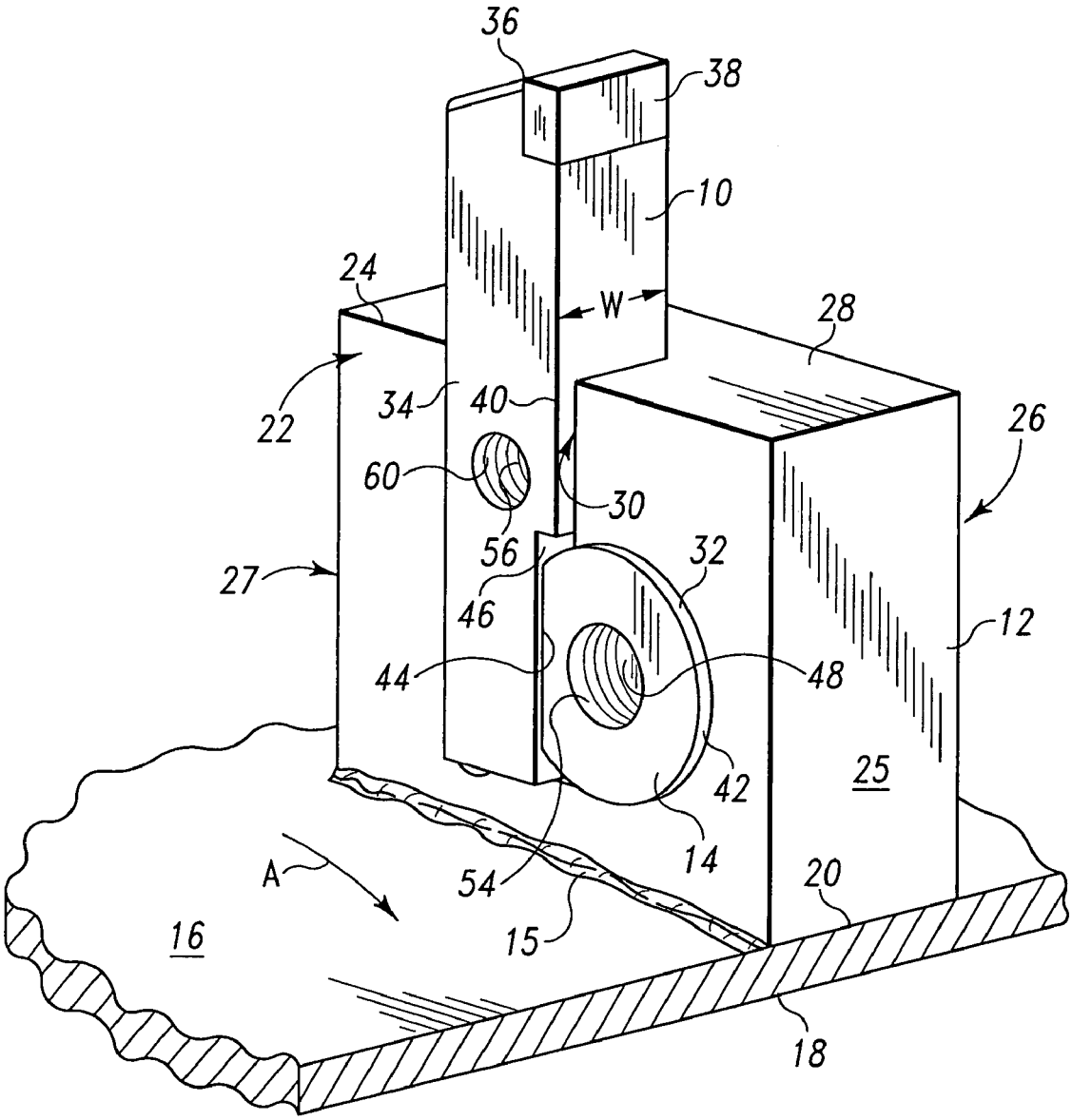
FIG. 1 is a perspective view of the front and side of a tool, holder and retainer of the present invention mounted to the curved surface of a rotary driven cutter.
Figure 2:
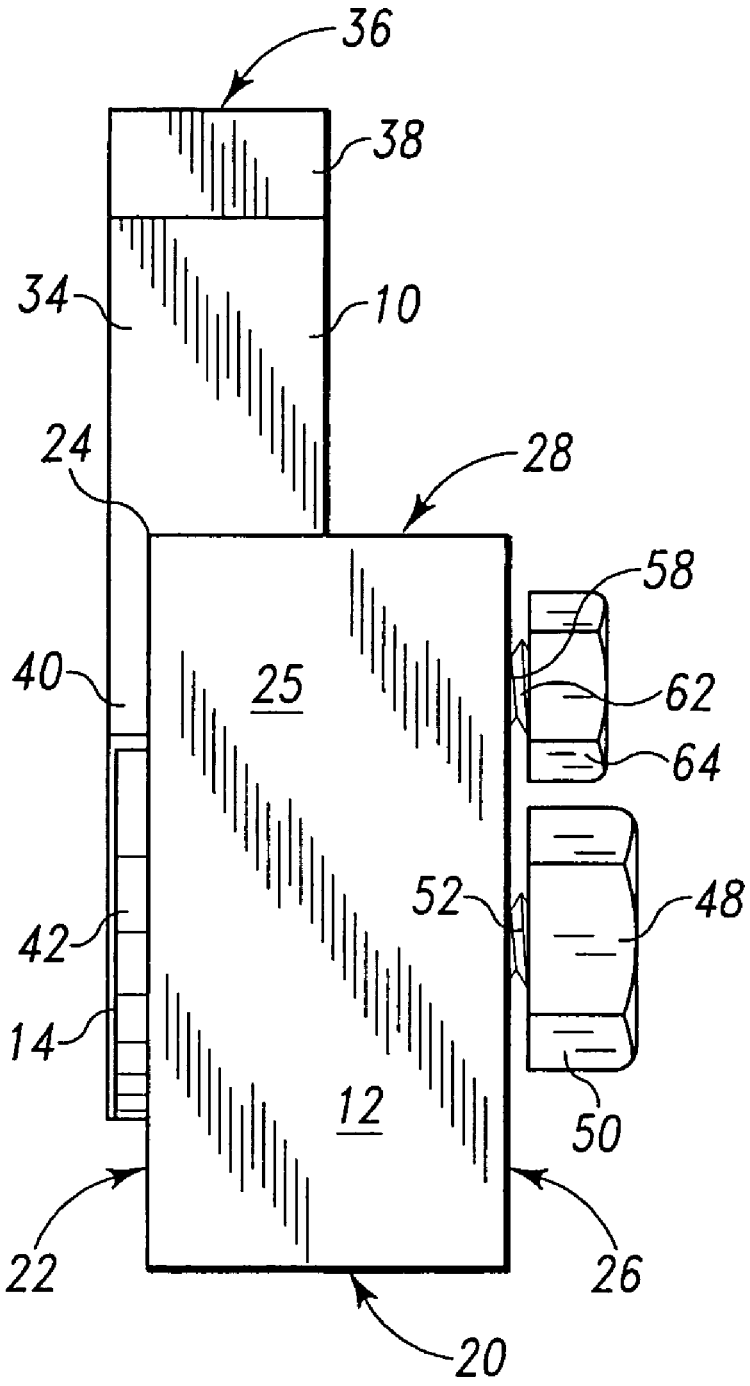
FIG. 2 is a front plan view of the tool, holder and retainer shown in FIG. 1 with a tension element and fastener partially withdrawn.
Figure 3:
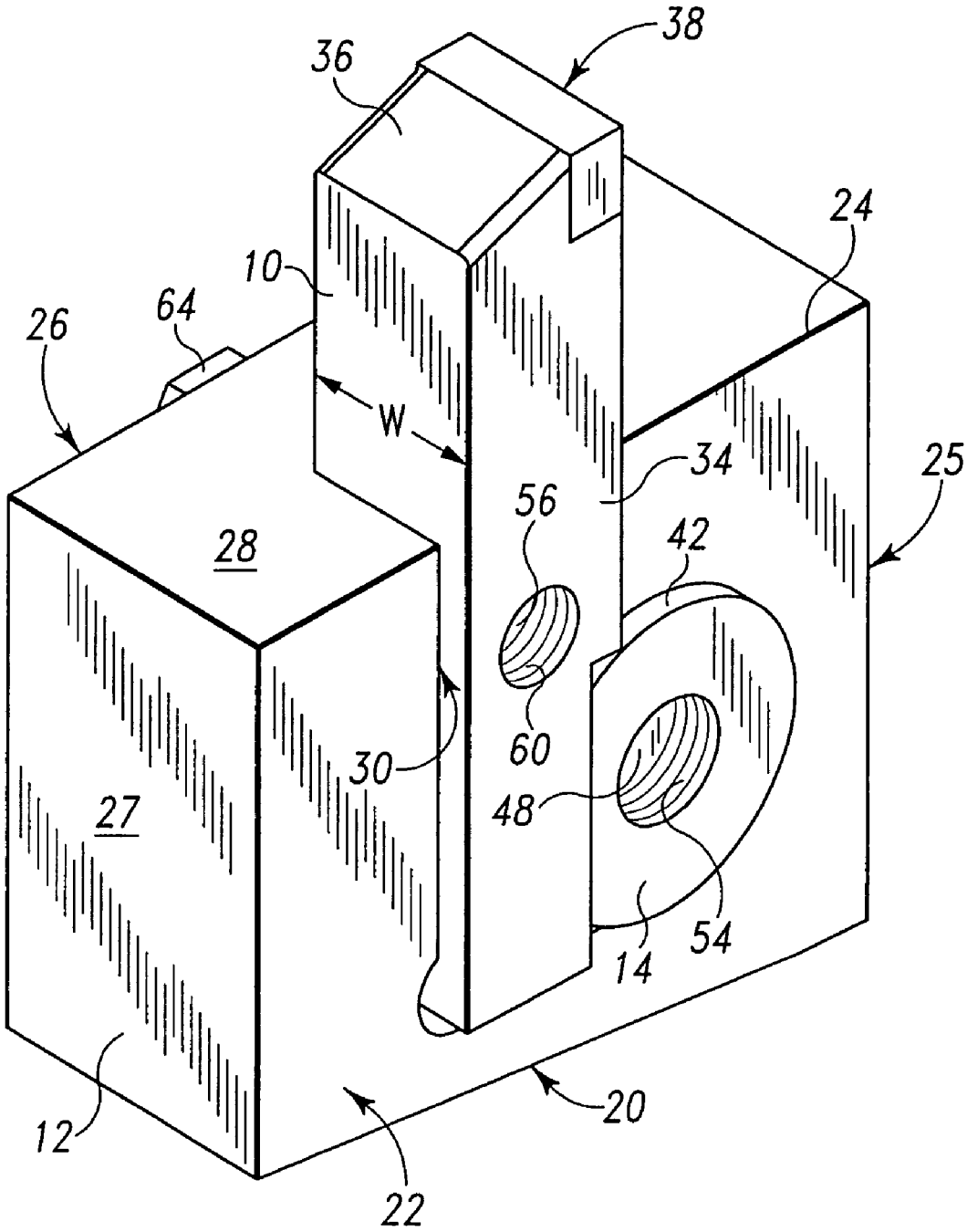
FIG. 3 is a perspective view of the back and same side of the tool, holder and retainer shown in FIG. 1.

A combined cutting tool or bit 10, holder 12 and retainer 14 are shown in FIGS. 1–3. The holder 12 is shown in FIG. 1 to be fixed by weld 15 to a curved surface 16 of a rotary driven cutter drum 18 for movement in the direction of arrow A. The tool holder 12 includes a base 20 that can be curved to be arcuately concave to match the curved surface 16 of the drum 18. The tool holder base 20 can also include a flat portion as shown in FIG. 3 that can be selected to set at a desired rake angle for the tool or bit 10. A first lateral surface 22 extends upward from the base 20 to an uppermost edge 24 of the lateral surface 22. A second lateral surface 26 is provided on the opposite side of the holder 12. The second lateral surface 26 can be parallel and similarly dimensioned to the first lateral surface 22. A top or crown surface 28 connects the uppermost edges 24 of the lateral surfaces 22 and 26. The top or crown surface 28 can be planar or curved. A front surface 25 connects the lateral surfaces 22 and 26 at a forward end of the holder 12. A back surface 27 is situated at the rearward end of the holder 12. The front surface 25 and back surface 27 can be planar and can be parallel, as shown.

A slot 30 is located in the first lateral surface 22 between the front and back surfaces 25 and 27. The slot 30 extends through the crown surface 28 and receives the cutting tool 10. The cutting tool 10 includes a body portion 34 that is dimensioned so that the cutting bit body can be at least partially received in the tool holder slot 30 at a fixed orientation. When so received, an upper end 36 of the cutting tool 10, which includes a cutting surface 38, projects above the tool holder top surface 28. The cutting bit body portion 34 can have a lateral dimension w exceeding the corresponding lateral dimension of the tool holder slot 30 so that an edge 40 of the cutting bit body portion 34 projects from the tool holder first lateral surface 22. The cross-sectional shape of the cutting bit body portion 34 can be generally rectangular, including square, but other angular shapes are also acceptable if suitably dimensioned to be received in the slot 30 of the tool holder 12.

Figure 10:
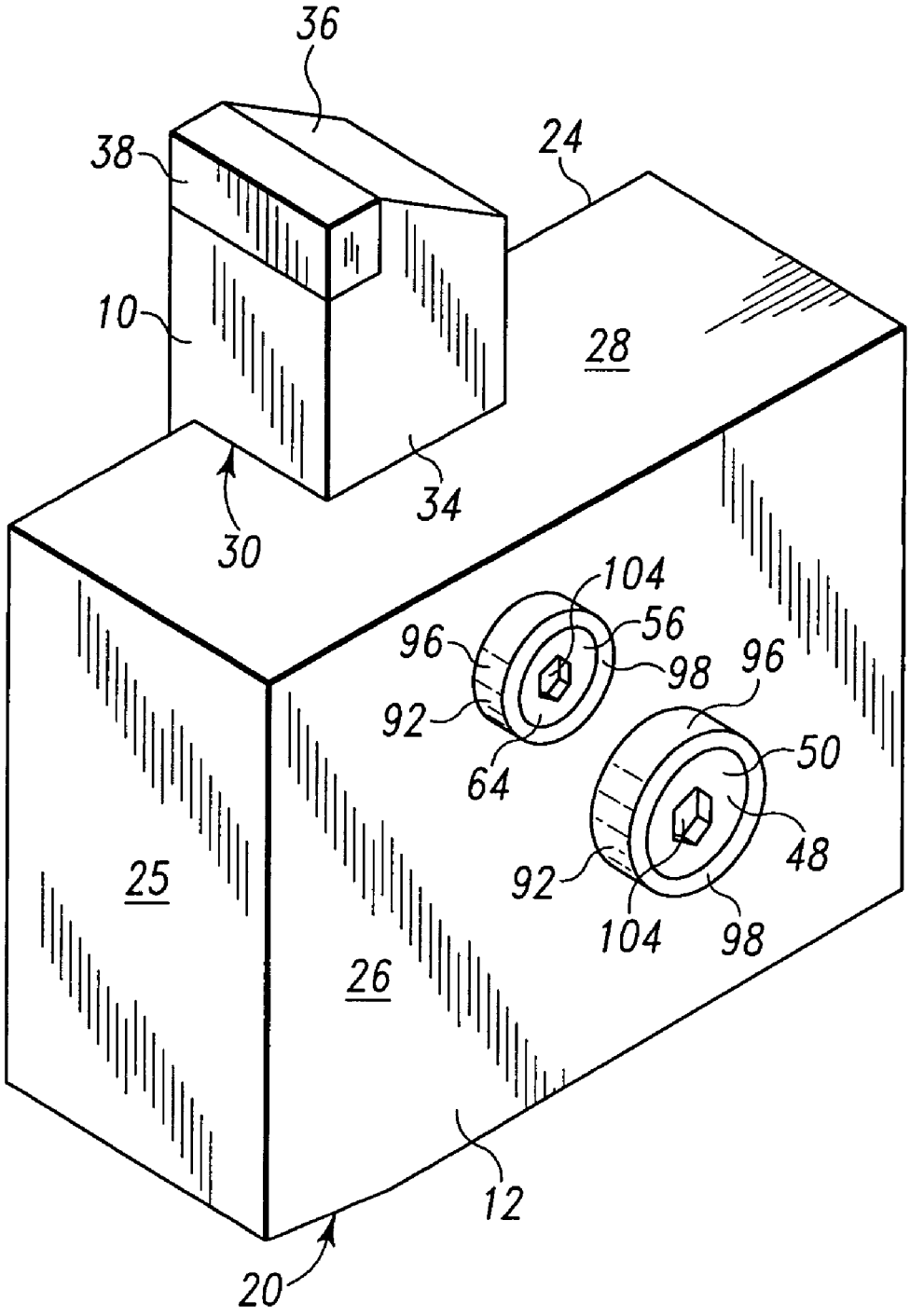
FIG. 10 is a perspective view of the front and opposite side of the tool and holder shown in FIG. 3.
Figure 11:
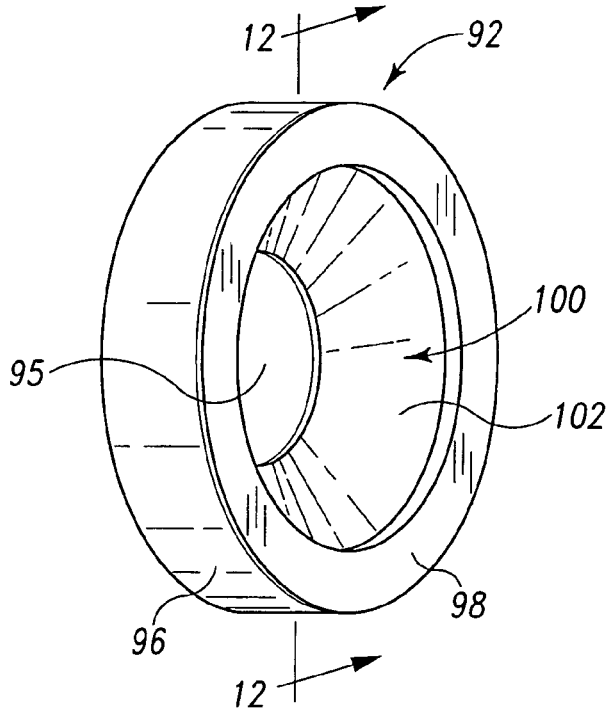
FIG. 11 is a perspective view of a protective washer used to surround the heads of the fastener and tension elements as shown in FIG. 10.
Figure 12:
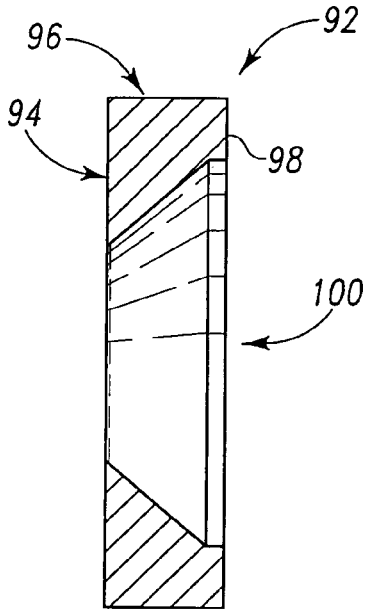
FIG. 12 is a sectional view of the protective washer shown in FIG. 11.

An opening 32 is included on the first lateral surface 22 that intercepts the slot 30 and receives the retainer 14. The retainer 14 has a perimeter surface 42 dimensioned to be received in the opening 32 in the tool holder first lateral surface 22. The retainer 14 also includes a contact surface 44, discussed in greater detail in connection with FIGS. 4–6, which is adapted to contact a lower surface 46 of the cutting tool 10. The surface 46 is discussed in greater detail in connection with FIGS. 7–9. A tension element 48 extends between the retainer 14 and the second lateral surface 26 to apply a force drawing the retainer 14 into the tool holder opening 32. The tension element 48 can be a screw threaded fastener as shown in FIG. 2 having a head 50 positioned outside the second lateral surface 26 of the tool holder 12 and a threaded portion 52 engaged in a threaded opening 54 in the retainer 14. One embodiment of the tension element 48 is discussed in greater detail in connection with FIGS. 10–12. Mutual contact between the retainer surface 44 and the cutting bit surface 46 can be facilitated by making the opening 32 in the tool holder first lateral surface 22 circular and the retainer perimeter surface 42 cylindrical so that the retainer 14 can, if necessary, rotate within the opening 32 to achieve a desired alignment.

An additional retention element 56 can be provided to help secure the cutting bit 10 to the, tool holder 12. For example, the tool holder can include an opening 58 in the second lateral surface 26 aligned with the slot 30 in the first lateral surface 22. The rectangular body portion 34 of the cutting bit 10 can also include an opening 60 positioned to be aligned with the opening 58 in the second lateral surface 26. The fastener 56 can be inserted into the aligned openings 58 and 60 to help secure the cutting bit 10 to the tool holder 12. The fastener 56 can include a threaded portion 62 for engaging the cutting bit 10 and a head 64 positioned outside the second lateral surface 26 of the tool holder 12. One embodiment of the fastener 56 is discussed in greater detail in connection with FIGS. 10–12. By suitably tightening the fastener 56 the head 64 will abut surface 26 to secure the cutting bit 10 in the slot 30 of the tool holder 12.

Figure 4:
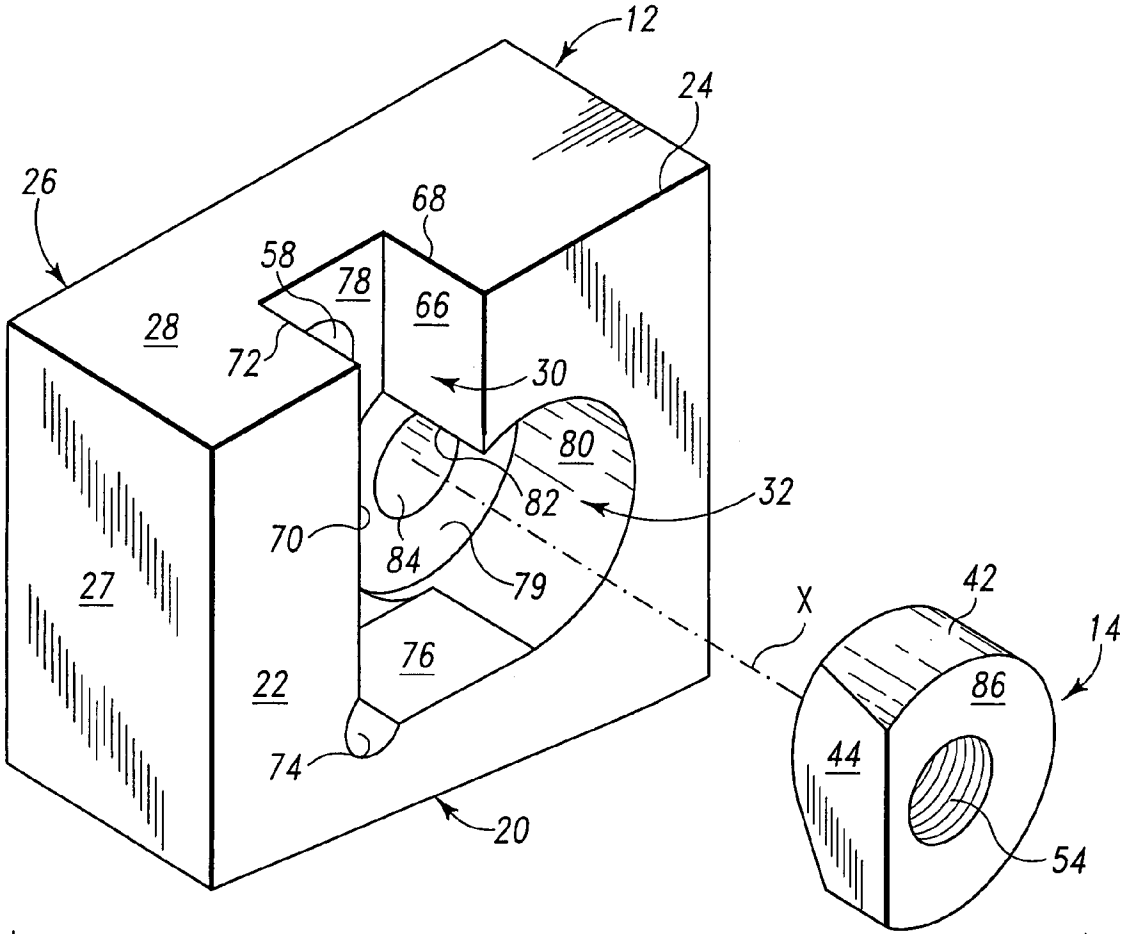
FIG. 4 is an exploded perspective view of the tool holder and retainer shown in FIG. 3.

The slot 30 can be better seen in FIG. 4 to be located in the first lateral surface 22 and to extend through the top surface 28 of the tool holder 12. The slot 30 is defined by a front surface 66 that is generally planar and can be perpendicular to the first lateral surface 22. An intersection of the front surface 66 and top surface 28 defines a front top edge 68 of the slot 30. The slot 30 is also defined by a back surface 70 that can be planar and parallel to the front surface 66. An intersection of the back surface 70 and top surface 28 defines a back top edge 72. A bore 74 can be provided at the base of the back surface 70. A bottom surface 76 situated above the base 20 provides a lower termination for the slot 30. An inside lateral surface 78, which can be parallel to the first and second lateral surfaces 22 and 26, respectfully, completes the surfaces defining the slot 30. The inside lateral surface 78 can be perpendicular to the front and back surfaces 66 and 70, respectfully, in which case the slot 30 is rectangular in vertical cross-section. By inclining one or both of the front and back surfaces 66 and 70 with respect to the inside lateral surface, the slot 30 can acquire a trapezoidal or parallelogram shape in vertical cross-section. Of course, the body portion 34 of the cutting tool 10 must be shaped accordingly to achieve a desirable close-fitting relationship. An opening 58 in the inside lateral surface 78 is provided to receive fastener 56 to help secure the cutting bit 10 in the slot 30.

The opening 32 in the first lateral surface 22 is defined generally by an interior surface 80 that intercepts the front surface 66 of slot 30 along edge 82. The interior surface 80 can also merge with the bottom surface 76. As shown in FIG. 4, the interior surface 80 is arcuate and uniformly spaced from an axis X so that a retainer 14 having a cylindrical perimeter surface 42 can be received in the opening 32. The interior surface 80 can have other shapes than that illustrated, such as hexagonal. The axis X can be aligned with the center of an opening 84 in the second lateral surface 26 that receives the tension element 48. The interior surface 80 can be perpendicular to the inside lateral surface 78, but could also have other shapes that could aid in correctly positioning the retainer 14 within the opening 32. In particular, a portion 79 of the inside lateral surface 78 surrounding the opening 84 can be concave or conical to as to aid in centering the retainer 14 within the opening 32.

Figure 5:
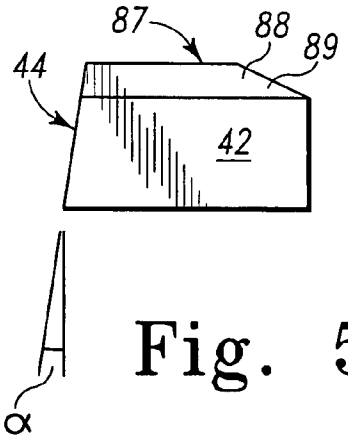
FIG. 5 is an elevation view of the retainer shown in FIGS. 1 through 4.
Figure 6:
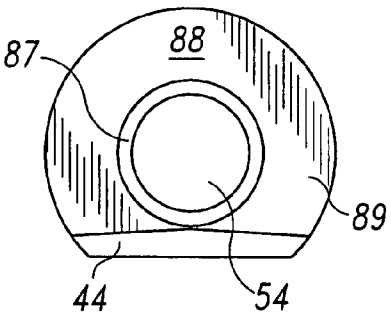
FIG. 6 is a plan view of the retainer shown in FIG. 5.

The perimeter surface 42 of the retainer 14 will generally reflect the shape of the surface 80 of the opening 32. The retainer 14 is shown in FIGS. 4–6 to include an outer face 86 and an inner face 88 that generally provide outer and inner limits for the perimeter surface 42. The contact surface 44 on retainer 14 can also extend between the outer face 86 and the inner face 88. The inner face 88 can include a portion 87 that is planar and generally parallel to the outer face 86. The inner face 88 can also include a tapered or domed portion 89 that can interact with any concave or conical surface 79 in the tool holder 12. If both a planar portion 87 and a tapered portion 89 are included, the area of the two portions need not be as illustrated, the relative sizes or surfaces 87 and 89 being a choice of design. The contact surface 44 is preferably planar and inclined with respect the axis X, which desirably passes through the center of opening 54. The angle of inclination $\alpha$ of surface 44 with respect to axis X is desirably related to the angle of inclination of the contact surface 46 on the cutting tool 10 to be held by the retainer 14. In general, the angle of inclination $\alpha$ can range from about 2° to about 20°, but preferably ranges from about 5° to about 15°. In one preferred embodiment, the angle of inclination $\alpha$ of surface 44 with respect to axis X is about equal to the lateral angle $\delta$ of surface 46 on the cutting bit 10 discussed below.

A cutting bit or tool 10 of the present invention is shown in greater detail in FIGS. 7–9 to include a body portion 34 that is shaped and dimensioned so that the cutting bit 10 can be at least partially received in the slot 30 of tool holder 12 at a fixed orientation. For example, the body portion 34 of the cutting tool 10 can be square in horizontal cross-section, but other angular shapes are also acceptable if suitably dimensioned to be received in a similarly shaped slot 30 of tool holder 12. The cutting tool 10 has an upper end 36 that generally includes a cutting surface 38, typically defined by a hardened material such as carbide. A lower end 90 of the cutting bit 10 can be positioned in contact with the bottom surface 76 of the tool holder 12. A lower surface 46 of the cutting tool 10 is provided for interaction with a retainer such as retainer 14. The lower surface 46 is generally planar and tapered so that the surface 46 is obliquely inclined to face laterally and upwardly. The vertical angle of inclination of surface 46 shown in FIG. 9 as angle $\beta$ can range from about 1° to about 10°. The lateral angle of the tapered surface 46 is shown in the bottom plan view of FIG. 8 as angle $\delta$, which can be between about 5° and 15°. In a particularly preferred embodiment, the surface 46 has a vertical angle $\beta$ of about 3°, and a lateral angle $\delta$ of about 10°, preferably matching the angle of inclination $\alpha$ of surface 44 on retainer 14.

The interaction of surface 44 on the retainer 14 and the lower planar tapered surface 46 on the bit 10 can be understood by considering the motion of the retainer 14 as it is drawn into opening 32 by tension element 48. With the angle of inclination $\alpha$ of surface 44 on retainer 14 closely matching the lateral angle $\delta$ of the tapered surface 46, the surfaces 44 and 46 tend toward sliding contact with each other as the tension element 48 is tightened. Any misalignment between the surfaces 44 and 46 causes the retainer 14 to rotate slightly within opening 32 to align with or conform to the vertical angle $\beta$ of the tapered surface 46 so that the tapered surface 44 on retainer 14 causes a downward and laterally inward force to be applied to a lower end of the bit 10. The pressure generated by the tension element 48 acts to hold the lower end 90 of the cutting bit 10 in firm contact with the bottom surface 76 of the tool holder 12. This firm contact together with the retention forces applied by fastener 56 greatly inhibit any relative movement between the cutting bit 10 and the tool holder 12 during operation of the cutting tool, thereby prolonging the life of the cutting bit 10 and holder 12 by avoiding abrasively enhanced relative movement. Any movement of the cutting bit 10 can be further inhibited by the fastener 56 that can engage opening 60 to help secure the cutting bit 10 in slot 30 of the tool holder 12.

While the heads 50 and 64 can simply be of standard hexagonal shape as shown in FIG. 2, in highly abrasive environments, such standard heads quickly become worn to the point that standard sized tools, such as wrenches, no longer are able to loosen and withdraw the element to which the heads 50 and 64 are connected. This situation can be prevented by the use of wear resistant washers 92 shown in FIGS. 10 through 12. The washers 92 can include a generally planar surface 94 intended to abut surface 26 of the holder 12. The surface 94 includes a central opening 95 that receives the threaded portion 52 or 62 of the tension element 48 or fastener 56, respectively. The washers 92 can also include a perimeter surface 96 extending away from surface 26 until it terminates at an outer surface 98 that can be generally planar. The outer surface 98 is generally in the form of a ring surrounding a recess 100 that can include an inner tapered wall 102 surrounding the opening 95. The recess 100 is designed to receive the head 50 or 64 that is suitably shaped to abut the tapered wall 102. The heads 50 and 64 include a central recessed engaging surface 104 for interaction with a suitable tool such as an Allen wrench or Phillips screw driver. The washers 92 can be suitably hardened to resist abrasive wear so that they protect the heads 50 and 64 from passing debris. The combination of the wear resistant washer 92 and the central engaging surface 104 for the heads ensures a long life to the fasteners 56 and tension elements 48 used in the present invention.

The foregoing detailed description should be regarded as illustrative rather than limiting, and the following claims, including all equivalents, are intended to define the spirit and scope of this invention.

The invention claimed is:

1. A cutting tool comprising:

a tool holder including a base, lateral surfaces extending upward from the base to an uppermost edge of each lateral surface, a top surface connecting uppermost edges of the lateral surfaces, a slot in a first of the lateral surfaces extending through the top surface, and an opening in the first lateral surface intercepting the slot, a retainer having a perimeter surface dimensioned to be received in the opening in the tool holder first lateral surface through movement of the retainer relative to the tool holder along a line of action, the retainer including a planar tapered surface inclined with respect to the line of action and intersecting the perimeter surface, and a cutting bit including a generally rectangular body portion dimensioned to be received in the slot at a fixed orientation, an upper end projecting above the tool holder top surface and including a cutting surface, and a lower planar tapered portion obliquely inclined to face laterally and upwardly and positioned for contact by the retainer planar tapered surface so that a downward and laterally inward force can be applied to the cutting bit by the retainer to maintain the cutting bit in the tool holder slot.

2. The cutting tool of claim 1 wherein the tool holder slot and the body portion of the cutting bit are both generally rectangular.

3. The cutting tool of claim 1 wherein the opening in the first lateral surface of the tool holder is circular and the retainer comprises a cylindrically shaped body having an axis aligned with the line of action.

4. The cutting tool of claim 1 wherein the tool holder further comprises an opening in a second of the lateral surfaces aligned with the line of action and a tension element extending between the retainer and the second lateral surface for applying a force drawing the retainer into the tool holder opening.

5. The cutting tool of claim 4 wherein the tension element comprises a screw threaded fastener engaged in a threaded opening in the retainer, the fastener having a head positioned outside the second lateral surface of the tool holder.

6. The cutting tool of claim 1 wherein the tool holder further comprises an opening in a second of the lateral surfaces aligned with the rectangular slot, and wherein the rectangular body portion of the cutting bit includes an opening alignable with the opening in the second lateral surface and adapted to receive a fastener.

7. The cutting tool of claim 1 wherein the cutting bit body portion has a lateral dimension exceeding the lateral dimension of the tool holder rectangular slot so that an edge of the cutting bit body portion projects from the tool holder first lateral surface.

8. The cutting tool of claim 1 wherein the lower planar tapered portion of the cutting bit is upwardly inclined at an angle of between about 1° and 5° and laterally inclined at an angle of between about 5° and 15°.

9. The cutting tool of claim 1 wherein the tool holder base is arcuately concave to facilitate fixation of the tool holder to a cylindrical drum.

10. The cutting tool of claim 1 wherein the tool holder base is angled to set a desired rake angle for the cutting bit relative to the drum.

11. The cutting tool of claim 1 wherein the tool holder includes front and rear surfaces that are generally perpendicular to the lateral surfaces.

12. The cutting tool of claim 1 wherein the cutting surface of the cutting bit comprises a carbide insert fixed in a step in the upper end.

13. A rotary driven cutter having a surface curved about a rotation axis of the cutter and a plurality of cutting tools mounted on the curved surface, each of the cutting tools comprising:

a tool holder including a base fixed to said curved surface, lateral surfaces extending radially outward from the base to an outermost edge of each lateral surface, a crown surface connecting outermost edges of the lateral surfaces, a slot in a first of the lateral surfaces extending through the crown surface, and an opening in the first lateral surface intercepting the slot, a retainer having a perimeter surface dimensioned to be received in the opening in the tool holder first lateral surface through movement of the retainer relative to the tool holder along a line of action, the retainer including a planar tapered surface inclined with respect to the line of action and intersecting the perimeter surface, and a cutting bit including an angular body portion dimensioned to be received in the slot at a fixed orientation, an upper end projecting above the tool holder crown surface and including a cutting surface, and a lower planar tapered portion obliquely inclined to face laterally and radially outwardly and positioned for contact by the retainer planar tapered surface so that a radially and laterally inward force can be applied to the cutting bit by the retainer to maintain the cutting bit in the tool holder slot.

14. The rotary driven cutter of claim 13 wherein the opening in the first lateral surface of the tool holder is circular, the tool holder further comprises an opening in a second of the lateral surfaces aligned with the line of action, and the retainer comprises a cylindrically shaped body having a central threaded opening aligned with the line of action.

15. The rotary driven cutter of claim 14 further comprising a threaded tension element engaging the central threaded opening of the retainer and extending between the retainer and the second lateral surface of the tool holder, the tension element having a head positioned outside the second lateral surface of the tool holder for applying a force drawing the retainer into the tool holder opening.

16. The rotary driven cutter of claim 15 wherein the lower planar tapered portion of the cutting bit is radially inclined at an angle of between about 1° and 5° and laterally inclined at an angle of between about 5° and 15°, and the planar tapered surface of the retainer is inclined at an angle approximating the laterally inclined angle of the cutting bit.

17. The rotary driven cutter of claim 16 wherein the tool holder slot is generally rectangular and the body portion of the cutting bit is square and dimensioned to exceed the lateral dimension of the tool holder slot so that an edge of the cutting bit body portion projects from the tool holder first lateral surface, the body portion of the cutting bit including an opening alignable with a further opening in the second lateral surface for receiving a fastener.

* * * * *